US005557823A

United States Patent [19]

Rouda

[11] Patent Number: 5,557,823

[45] Date of Patent: Sep. 24, 1996

[54] VACUUM CLEANER ATTACHMENT

[75] Inventor: Dawn V. Rouda, Lancaster, Pa.

[73] Assignee: JMA & Associates, Indian Wells, Calif.

[21] Appl. No.: 452,393

[22] Filed: May 26, 1995

[51] Int. Cl.[6] ..... A47L 9/06

[52] U.S. Cl. ..... 15/400; 15/415.1

[58] Field of Search ..... 15/393, 398, 399, 15/400, 415.1

[56] References Cited

U.S. PATENT DOCUMENTS

| | | | |
|---|---|---|---|
| 2,130,635 | 9/1938 | Dow et al. | 15/400 X |
| 3,745,605 | 7/1973 | Gitschel et al. | 15/400 |
| 3,820,189 | 6/1974 | Roth | 15/400 |
| 3,828,386 | 8/1974 | Roth | 15/106 |
| 3,833,962 | 9/1974 | Krusche | 15/400 |
| 4,319,379 | 3/1982 | Carriagan et al. | 15/400 |
| 4,888,852 | 12/1989 | Varin | 15/400 |

FOREIGN PATENT DOCUMENTS

| | | | |
|---|---|---|---|
| 810390 | 8/1951 | Germany . | |
| 7315595 | 11/1973 | Netherlands | 15/400 |

*Primary Examiner*—Chris K. Moore
*Attorney, Agent, or Firm*—Alan R. Davis; Louis L. Dachs

[57] ABSTRACT

The invention is a vacuum cleaner attachment. In detail, the invention includes a nozzle body having a hollow tubular member for connecting to the vacuum pipe of a vacuum cleaner. The side of the body turned away from the member includes front and rear openings. The rear opening includes front, rear and side walls and is in communication with the hollow tubular member. The front opening includes a semi-flexible front wall and side walls and the front wall of the rear opening as the rear wall thereof. Each of the side walls of the front opening include one half of a detent thereon. A cleaning pad support is removably mountable in the front opening of the body. The pad support includes upstanding front, side and rear walls, a top surface and a pad of plush-like slanted filaments mounted on the bottom surface. Each of the side walls of the support includes a second half of the detent thereon. The pad support is adapted to fit within the front opening of the body such that the front wall of the pad support is in engagement with the front wall of the front opening of the body and first and second halves of the detent are in releasable engagement when the pad support is installed therein.

5 Claims, 3 Drawing Sheets

FIG. 1
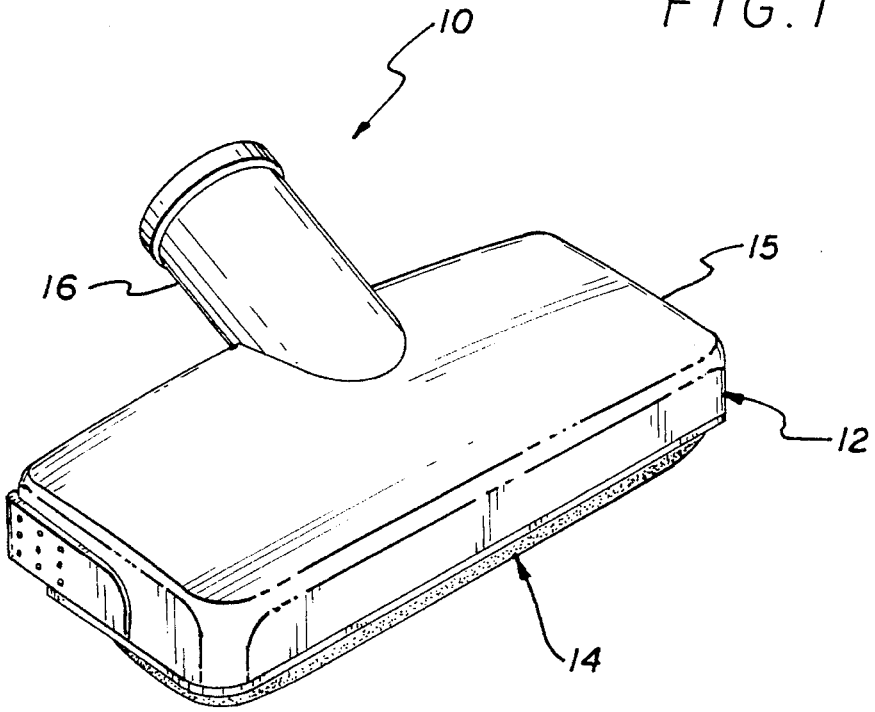
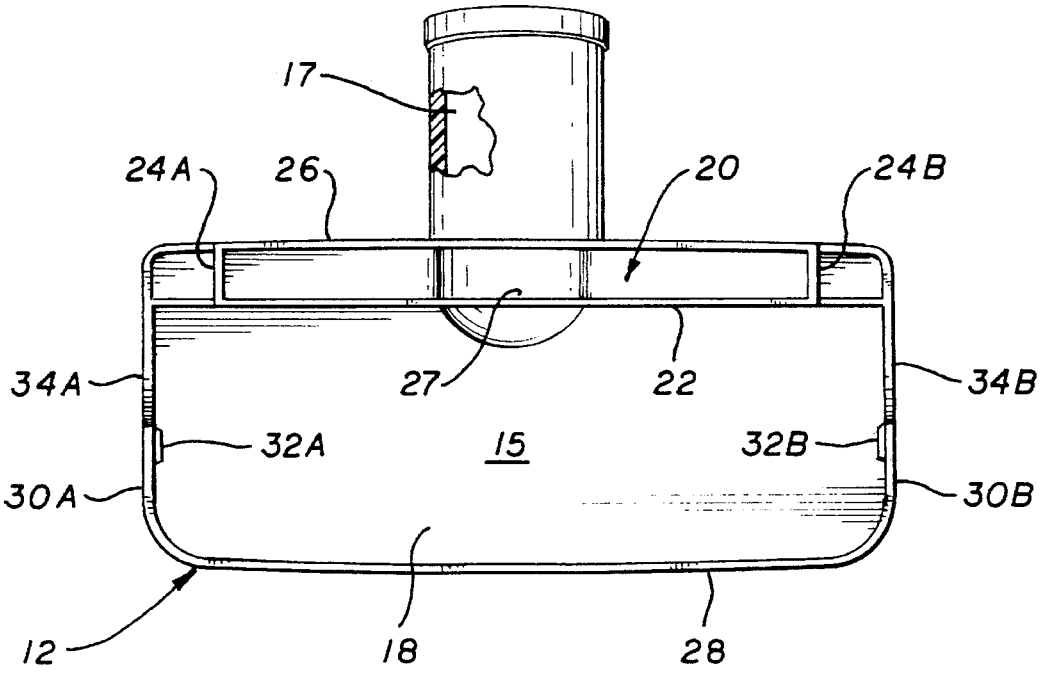
FIG. 2

FIG. 3
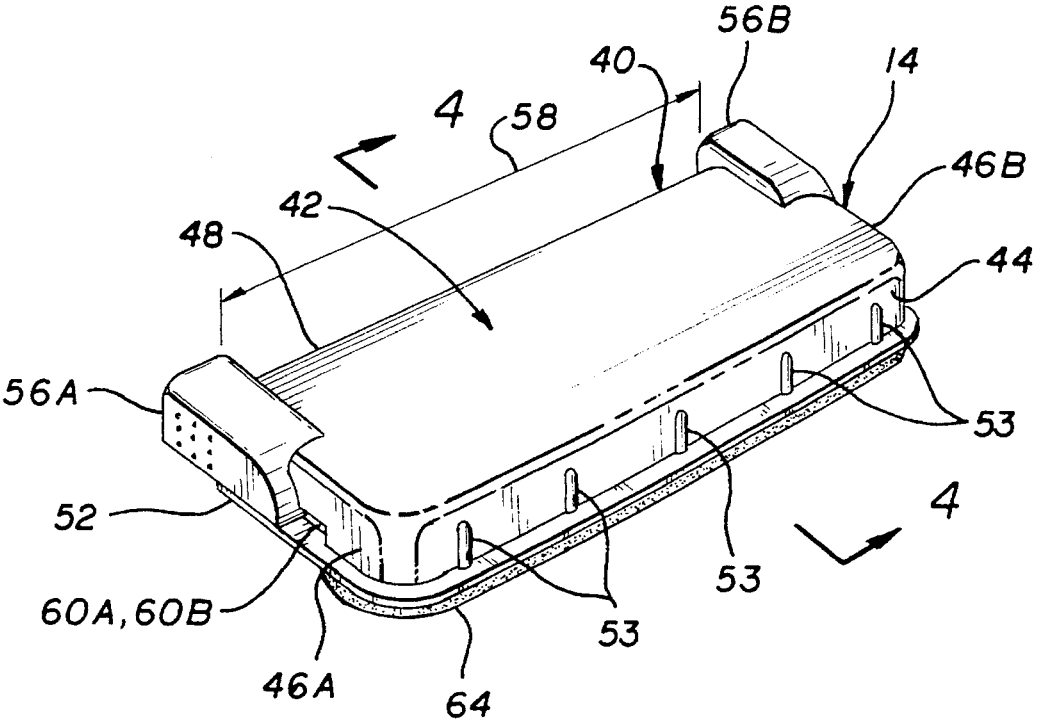
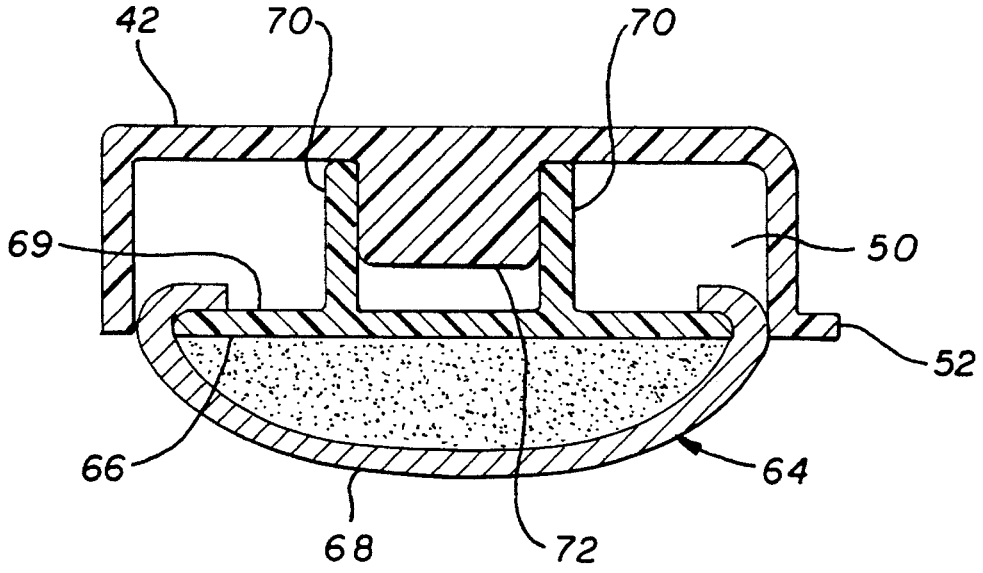
FIG. 4

FIG. 5
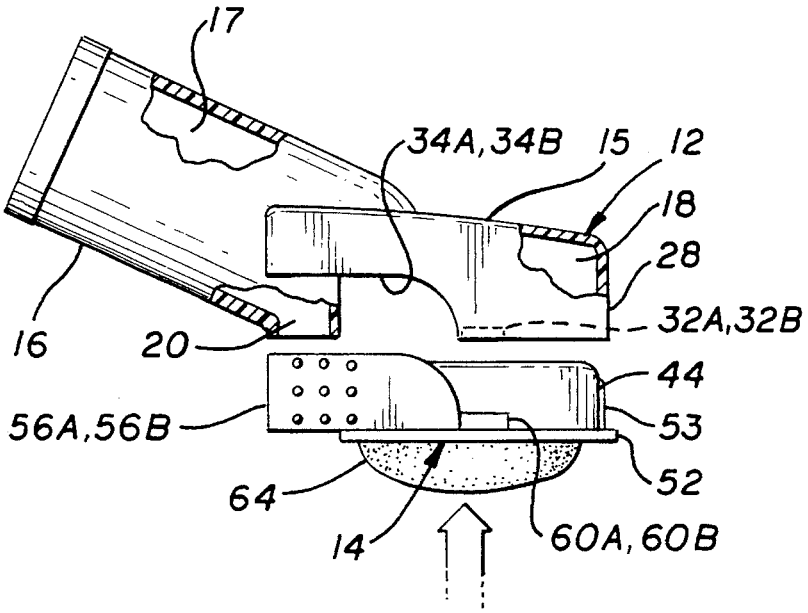
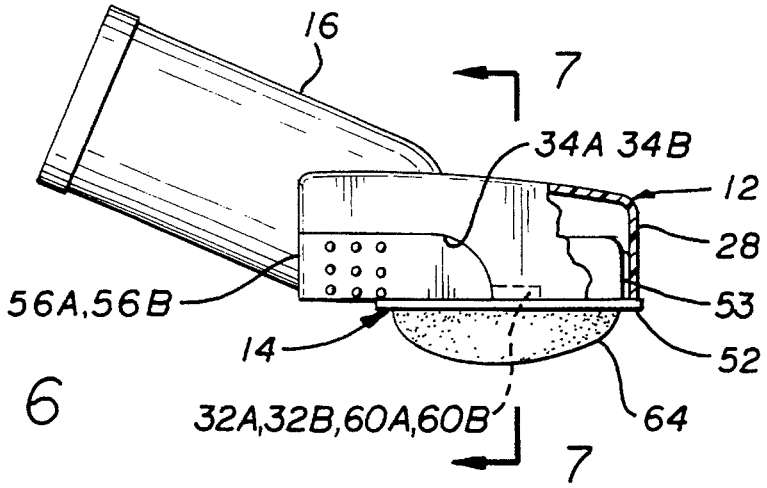
FIG. 6
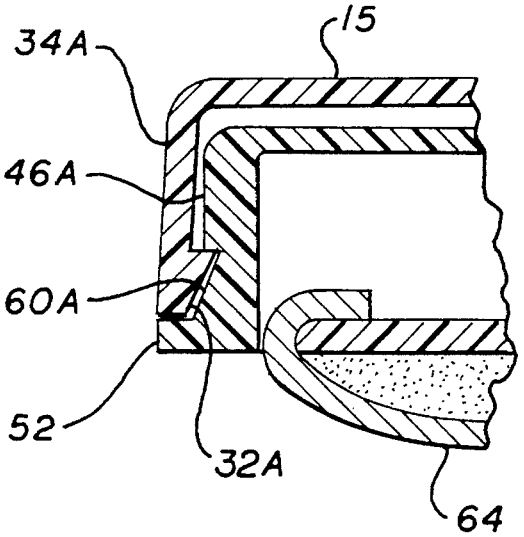
FIG. 7

VACUUM CLEANER ATTACHMENT

BACKGROUND OF THE INVENTION

1. Field of the Invention

The invention relates to the field of vacuum cleaner attachments and, in particular, to one having a replaceable cleaning pad.

2. Description of Related Art

Most vacuum cleaners encounter difficulty in picking up hairs, lint, and the like because they tend to hold to woven materials such as rugs and fabric covered furniture. Thus it is common practice to incorporate attachments to the end of the vacuum lines that include cleaning pads or brushes to loosen and comb the lint out of these woven materials so that they can be subsequently "picked up" by the vacuum cleaner. One cleaning pad material used in such devices comprises woven fibers or filaments that are inclined in the same direction such that when the fibers are brushed across in one direction they lie down without frictionally grasping the lint and/or hairs. When stroked in the opposite direction, they tend to stand up and frictionally engage the lint and act as a rake to loosen it up so that they are easily picked up by the vacuum cleaner. Such an attachment fitting using such material is disclosed in U.S. Pat. No. 4,319,379 "Pickup" by W. J. Carrigan. However, the Carrigan device incorporates a complicated system for attaching the pad to the fitting that requires special fasteners that can easily be lost or broken.

In U.S. Pat. No. 3,833,962 "Nozzle For Vacuum Cleaner" by K. Krusche, an attachment fitting is disclosed wherein the cleaning pad includes a rod like fitting that extends through a hole in the top surface of the fitting and which is held therein by a détente. While simpler than the Carrigan device, it is prone to the collection of dust and dirt around the hole. When the cleaning pad is removed, the collected dust can be easily fall to the floor In U.S. Pat. No. 3,820,189 "Brush Adapter For Vacuuming" by E. M. Roth, a system is disclosed wherein the vacuum is drawn through an aperture in a replaceable cleaning pad. The cleaning pad is mounted to a housing by a complicated clamping arrangement wherein the pad is secured to a detachable mounting plate by means of a hollow retainer that extends through the pad and locks it to mounting plate. This design is overly complicated and requires too much time for pad replacement. U.S. Pat. No. 3,828,386 "Rug Care Implement" by E. M. Roth shows a similar system. German Patent No. 810,390 also discloses a complicated system for mounting a cleaning brush insert into a vacuum cleaner attachment.

Thus, it is a primary object of the invention to provide a vacuum cleaner attachment having a removable cleaning pad.

It is another primary object of the invention to provide a vacuum cleaner attachment having a removable cleaning pad that picks up lint, hairs and the like.

It is a further object of the invention to provide a vacuum cleaner attachment having a removable cleaning pad that picks up lint and/or hairs one direction and releases it when moved in the opposite direction, and further includes a vacuum pickup that picks up the released lint and the like when it is moved in the opposite direction.

It is a still further object of the invention to provide a vacuum cleaner attachment having a removable cleaning pad that can only be installed with the proper orientation.

It is another object of the invention to provide a vacuum cleaner attachment having a removable cleaning pad that is easy to remove and replace.

SUMMARY OF THE INVENTION

The invention is a vacuum cleaner attachment. In detail, the attachment includes a nozzle body having a hollow tubular member for connecting to the vacuum tube of a vacuum cleaner. The side of the body turned away from the member includes front and rear openings with the rear opening having front, rear and side walls and which is in communication with the tubular member. The front opening has semi-flexible front and side walls with the front wall of the rear opening as the rear wall thereof. Each of the side walls of the front opening incorporate one half of a detent on the interior thereof, preferably in the form of a protrusion.

A cleaning pad support is included that is in releasable engagement with the front opening of the nozzle body. The pad support includes upstanding front, side and rear walls, a top surface and a pad of plush-like slanted filaments mounted on the bottom surface. Each of the side walls of the support include the second half of the detent thereon, preferably in the form of a slot or notch. The support is adapted to fit within the front opening of the body such that the front wall of the pad support is in engagement with the front wall of the front opening and the first and second halves of the detent are in releasable engagement. Preferably, the front wall of the support includes a plurality of vertical protrusions in a spaced relationship that engage the front wall of the front opening of the body and cause an interference fit when the support is installed in the front opening of the body. Additionally, the side walls of the front opening include notches in the rear ends thereof; and the ends of the rear wall of the support includes protrusions adapted to fit into the notches when the support is inserted into the front opening of the body. Preferably, the support further includes a lip about the bottom edge of the front and side walls of the support, such that the lip limits the distance that the top surface of the support protrudes into the front opening of the body when the support is inserted therein.

The installation of the cleaning pad holder into the body is simple. The holder is positioned below the front opening of the body such that the front wall of the holder is aligned with the inner surface of the front wall of the front opening. The pad holder is pushed upward so that the protrusions on the front wall thereof engage the front wall of the front opening causing it to distort slightly. At the same time the protrusions mounted on the sides of the pad holder contact with the cut-away portions of the side walls. Continued pushing causes the lip to seat against the ends of the front and side walls of the front opening of the body. Simultaneously, the protrusions on the side walls of the pad holder slightly distort the side walls such that they come into engagement with the notches on the side walls of the front opening. At this point the side wall Is snap back and the pad holder becomes releasably engaged with the body. Removal of the pad holder is easily accomplished by just prying the protrusions on the side walls of the pad holder downward, which causes the pad holder to snap out of the front opening.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 1 is a perspective view of the vacuum cleaner attachment comprising a body and cleaning pad holder.

FIG. 2 is a bottom view of body.

FIG. 3 is a perspective view of the cleaning pad holder.

FIG. 4 is a cross-sectional view of the cleaning pad holder shown in FIG. 3 taken along the line 4—4.

FIG. 5 is a side view of the cleaning pad holder aligned for joining to the body.

FIG. 6 is a side view of the assembled cleaning pad holder and body joined together.

FIG. 7 is a partial cross-sectional view of assembled pad holder and body shown in FIG. 6 taken along the line 7—7.

DESCRIPTION OF THE PREFERRED EMBODIMENT

Referring to FIG. 1 through 4, the vacuum cleaner attachment, generally indicated by numeral 10, includes a nozzle body 12 and cleaning pad holder 14, releasably mounted thereto. The body 12 includes a top wall 15 having a hollow tubular fitting 16, with a passageway 17 therethrough, attached thereto for coupling to the vacuum hose of a vacuum cleaner (not shown). Front and rear openings, 18 and 20, respectively are located on the opposite side of the top wall 15. The rear opening 20 includes front wall 22, side walls 24A and 24B, and a rear wall 26 and includes a passageway 27 in communication with the passageway 17. The front opening 18 includes a semi-flexible front wall 28 and side walls 30A and 30B, and the front wall 22 of the rear opening 20 serving as the rear wall. The side walls 30A and 30B incorporate small protrusions 32A and 32B on the inner side that serve as detent halves for releasably securing the cleaning pad holder 14 to the body 12, in a manner to be subsequently discussed. The rear portions 34A and 34B of the side walls 30A and 30B are cut-away in an arc like shape.

The cleaning pad holder 14 includes a body 40 having a top wall 42, upstanding front wall 44, side walls 46A and 46B, and rear wall 48 having a bottom facing opening 50. A lip 52 projects outward from the opening 50 along the front wall 44 and side walls 46A and 46B. The front wall 44 incorporates a plurality of protrusions 53 that extend from the lip 52 a portion of the way thereup and have rounded ends. The rear portions 54A and 54B of the side walls 46A and 46B include protrusions 56A and 56B that extend rearward beyond the rear wall 48 and are spaced apart a distance 58 that is equal to the length of the rear wall 26 of the rear opening 20 of the body 12. Thus the protrusions 56A and 56B are adapted to mate with the rear cut-away portions 34A and 34B of the side walls 30A and 30B of the front opening 18 of the body 12. Notches 60A and 60B are located in the side walls 46A and 46B that are serve as détente halves that mate with protrusions 32A and 32B on the side walls 30A and 30B of the front opening 18 and serve as the second detent halves for releasably securing the cleaning pad hold 14 to the body 12.

The actual cleaning pad, indicated by numeral 64, includes a ridged plate 66 upon which a cleaning cloth 68 is placed thereover and about the edge and glued to the back side 69. A plurality of hollow protrusions 70 on the back side 69 mate with protrusions 72 extending downward from the top wall 42 and are glued thereto. The cleaning cloth comprises woven fibers or filaments that are inclined in the same direction such that when the fibers are brushed across in one direction they lie down without frictionally grasping lint. When stroked in the opposite direction, they tend to stand up and frictionally engage the lint and act as a rake to loosen them up so that they are easily picked up by the vacuum cleaner.

The installation of the cleaning pad holder 14 into the body 12 is simply accomplished. Referring particularly to FIGS. 5 through 7, the holder 14 is positioned below the front opening 18 of the body 12 such that the front wall 44 of the holder 12 is aligned with the inner surface of the front wall 28 of the front opening 18. The pad holder 14 is pushed upward so that the protrusions 53 on the front wall thereof engage the front wall 28 of the body causing it to distort slightly. At the same time the protrusions 56A and 56B are moved toward and into contact with the cut-away portions 34A and 34B of the side walls 30A and 30B of the front opening 18. Continued pushing causes the lip 52 to seat against the ends of the front and side walls of the front opening 18 of the body 12. The protrusions 32A and 32B slightly distort the side walls 24A and 24B and come into engagement with the notches 60A and 60B. At this point the side walls 30A and 30B snap back and the pad holder becomes releasably engaged with the body. Removal of the pad holder 14 is easily accomplished by just prying the protrusions 56A and 56B downward with one's fingers, which causes the pad holder to snap out of the front opening 18.

Thus, all the objects of the invention are accomplished. The cleaning pad, which is removable, picks up lint and/or hairs in one direction and releases it when moved in the opposite direction, and further includes a vacuum pickup that picks up the released lint and the like when it is moved in the opposite direction. The cleaning pad can only be installed with the proper orientation.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to the vacuum cleaning manufacturing industry.

What is claimed is:

1. A vacuum cleaner attachment comprising:

a nozzle body having a hollow tubular member for connecting to the vacuum pipe of a vacuum cleaner, the side of the body turned away from the member having front and rear openings said rear opening having front, rear and side walls and in communication with said member, said front opening having a semi-flexible front wall, side walls and said front wall of said rear opening as the rear wall thereof, each of said side walls of said front opening having one half of a detent thereon; and a cleaning pad support having upstanding front, side and rear walls, a top surface and a pad of plush-like slanted filaments mounted on the bottom surface, each of said side walls of said support having a second half of said detent thereon, said support adapted to fit within said front opening of said body such that said front wall of said pad support is in engagement with said front wall of said front opening and first and second halves of said detent are in releasable engagement.

2. The attachment as set forth in claim 1 comprising said front wall of said front opening has a convex shape; and said front wall of said support dimensioned to have an interference fit with said front wall of said front opening when said support is inserted into said front opening and said detent halves are engaged.

3. The attachment fitting as set forth in claim 2 comprising said front wall of said support having a plurality of vertical protrusions in a spaced relationship that engage said front wall of said front opening of said body and cause said interference fit when said support is installed in said front opening of said body.

4. The attachment fitting as set forth in claim 3 comprising said support having a lip about the bottom edge of said front and side walls of said support, such that said lip limits the distance that said top surface of said support protrudes in to said front opening of said body when said support is inserted therein.

5. The attachment fitting as set forth in claim 4 comprising:

said side walls of said front opening include notches in the rear ends thereof; and the ends of said rear wall of said support includes protrusions adapted to fit into said notches when said support is inserted into said front opening of said body.

* * * * *